US009649244B1

(12) United States Patent
Jacobs

(10) Patent No.: US 9,649,244 B1
(45) Date of Patent: May 16, 2017

(54) MYOFASCIAL RELEASE METHOD

(71) Applicant: Joseph Jacobs, Mission Viejo, CA (US)

(72) Inventor: Joseph Jacobs, Mission Viejo, CA (US)

( * ) Notice: Subject to any disclaimer, the term of this patent is extended or adjusted under 35 U.S.C. 154(b) by 358 days.

(21) Appl. No.: 14/468,045

(22) Filed: Aug. 25, 2014

(51) Int. Cl.
*A61H 7/00* (2006.01)

(52) U.S. Cl.
CPC ..... *A61H 7/003* (2013.01); *A61H 2201/1657* (2013.01)

(58) Field of Classification Search
CPC .. A61H 7/003; A61H 2201/1657; A61H 7/00; A61H 7/002; A61H 7/004; A61H 7/005; A61H 7/007; A61H 7/008
See application file for complete search history.

(56) References Cited

U.S. PATENT DOCUMENTS

| | | | | |
|---|---|---|---|---|
| 2,478,648 | A * | 8/1949 | Wheeler | A61H 7/003 601/155 |
| 3,736,921 | A * | 6/1973 | Kawada | A61H 9/005 601/112 |
| 4,485,807 | A * | 12/1984 | Gueret | A61H 7/003 601/154 |
| 5,843,005 | A | 12/1998 | Chubinsky | |
| 6,821,260 | B2 | 11/2004 | Fors | |
| 6,887,211 | B1 | 5/2005 | Sevier et al. | |
| 8,556,838 | B2 | 10/2013 | Moutray | |
| 2002/0151826 | A1* | 10/2002 | Ramey | A61H 9/005 601/6 |
| 2005/0049534 | A1* | 3/2005 | Wang | A61H 7/003 601/135 |
| 2007/0000566 | A1* | 1/2007 | Gueret | A45D 34/04 141/98 |
| 2008/0200854 | A1* | 8/2008 | Hobson | A61H 7/004 601/136 |
| 2009/0198159 | A1* | 8/2009 | Linzell | A61H 7/003 601/138 |
| 2012/0059405 | A1 | 3/2012 | Reynolds et al. | |
| 2012/0158040 | A1 | 6/2012 | Dehors | |
| 2012/0265106 | A1 | 10/2012 | Accardo et al. | |
| 2012/0271345 | A1 | 10/2012 | Torres | |
| 2013/0085426 | A1 | 4/2013 | Brodsky | |
| 2013/0090220 | A1 | 4/2013 | Bertram et al. | |
| 2014/0024984 | A1 | 1/2014 | Allen | |

FOREIGN PATENT DOCUMENTS

| | | |
|---|---|---|
| WO | WO 2012/068680 | 5/2012 |

OTHER PUBLICATIONS

Author: John F. Barnes; Title: Myofascial Release: The Search for Excellence; Date: Jan. 1, 1990; pp. 17-58; Publisher: Rehabilitation Services Inc.; Country: USA.

* cited by examiner

*Primary Examiner* — Steven Douglas
(74) *Attorney, Agent, or Firm* — Eric Karich; Karich & Associates

(57) ABSTRACT

A method for achieving myofascial release has the steps of: engaging an epidermis of the patient with firm gliding pressure; stretching the epidermis to a stretched position at which the movement is restricted by the restriction; holding the epidermis in the stretched position for less than 10 seconds; and then performing a series of rapid glides around the stretched position, with firm gliding pressure, to release the restriction.

11 Claims, 2 Drawing Sheets

MYOFASCIAL RELEASE METHOD

BACKGROUND OF THE INVENTION

Field of the Invention

This invention relates to methods for obtaining myofascial release in a patient having a fascial restriction.

Description of Related Art

The prior art teaches a variety of methods of treating myofascial restrictions. In the most common technique, taught by John F. Barnes, myofascial release is achieved by applying gentle but sustained pressure against the restriction for at least 90-120 seconds or longer. While the application of gentle and sustained pressure is effective in achieving release, it is time consuming, and can cause fatigue in the practitioner forced to hold the position for extended periods.

The present invention is unique in that the initial movement only need be maintained for a short period, typically 3-5 seconds, although the time may vary between 2-10 seconds in most cases. This initial movement is then followed with a series of rapid movements described in greater detail below, and this combination has been found to be as effective as prior techniques, if not more effective.

The prior art also teaches a variety of massage devices for massaging the deep tissue of a patient. For example: Moutray, U.S. Pat. No. 8,556,838, describes an ergonomic and therapeutic massage device having a top bulb-shaped portion and a bottom disc-shaped portion, and is generally molded from solid glass. The device provides improved ergonomics which reduces operator fatigue and discomfort while maximizing the experience of the massage. It provides a penetrating massage that effectively stimulates soft tissue structures, neural receptors and acupressure points, quickly providing pain and stress relief without exertion on the part of the operator. While the Moutray device is superficially similar to the myofascial release tool described herein, the device has important structural differences, and it is used in an entirely different manner to achieve different therapeutic effects.

Allen, U.S. 2014/0024984, describes a massage apparatus that includes two massage balls connected by an oversleeve. The massage apparatus is adapted for myofascial release techniques, and enables an individual to perform a variety of massages by applying targeted pressure to effected muscle groups. However, the Allen myofascial release techniques are different than the present invention. In one embodiment, the massage apparatus includes a plurality of generally spherical balls and an oversleeve shrink-fitted over at least a portion of the plurality of balls. The oversleeve includes a first open end and a second open end opposite the first open end. In one embodiment, a method of manufacturing a massage apparatus includes selecting a plurality of balls having a desired density, shape, and outer diameter, arranging the plurality of balls within an oversleeve, and subjecting the oversleeve to heat to longitudinally and radially contract the oversleeve between an original position and a contracted position around at least a portion of the balls.

Reynolds, U.S. 2012/0059405, describes a trigger point therapy device that includes a bell-shaped body with a base having a larger diameter than the tip. The tool and components can be used with a strap or roller attachment to allow users to relax and concentrate on their breathing, two key ingredients to successful neuromuscular release, rather than focus on applying pressure to the tool.

Hobson, U.S. 2008/0200854, discloses a method of treating muscle soreness or soft tissue edema (swelling). The method comprises frictionally engaging a contact member of an apparatus with skin portions of a patient. The contact member of the apparatus is arranged to perform a substantially planar orbital motion along the skin portions. The method further comprises applying the substantially planar orbital motion along the skin portions of the patient so that soft tissue adjacent the skin portion is locally moved in a corresponding manner. The movement typically is a non-circular orbital movement having a base frequency and harmonics. The movement of the soft tissue results in a distortion of portions of lymph nodes located within the soft tissue whereby throughput of lymphatic fluid through lymph nodes is enhanced.

Sevier, U.S. Pat. No. 6,887,211, describes an instrument for diagnosing and treating soft tissue abnormalities though augmented soft tissue mobilization. The instruments include a variety of curvilinear and linear tissue engaging edges and converging surfaces accommodating their use on the irregular contours of numerous soft tissue areas of the human body.

Other references included as a matter of general interest include the following: U.S. Pat. No. 5,843,005; US 2012/0158040; US 2012/0265106; US 2013/0085426; and WO2012/068680.

While various massage tools are well known in the art, the prior art does not teach a tool having the advantages of the tool described below, for use in releasing myofascial restrictions.

SUMMARY OF THE INVENTION

The present invention teaches certain benefits in construction and use which give rise to the objectives described below.

The present invention provides a method for achieving myofascial release of a restriction in a patient via manipulation of the patient's epidermis adjacent the restriction. The method comprises the steps of: engaging the epidermis of the patient with firm gliding pressure; stretching the epidermis to a stretched position at which the movement is restricted by the restriction; holding the epidermis for less than 10 seconds, and then performing a series of rapid glides in two dimensions, longitudinal, lateral, and diagonal, around the stretched position, with firm gliding pressure to release the restriction.

A primary objective of the present invention is to provide a method for achieving myofascial release having advantages not taught by the prior art.

Another objective is to provide a method that is fast and effective in achieving a release of the restriction.

Another objective is to provide a method of measuring a restriction on a scale to promote the effective release of the restriction.

A further objective is to provide a method of using a myofascial release tool that is effective, and which relieves the strain on the hands of the practitioner.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a method for achieving myofascial release of a restriction in a patient via manipulation of the patient's epidermis adjacent the restriction. The method may be practiced using a myofascial release tool 10 that is described in greater detail below, or the method may be practiced manually using the hands, or other tool suitable for this purpose.

Figure 1:
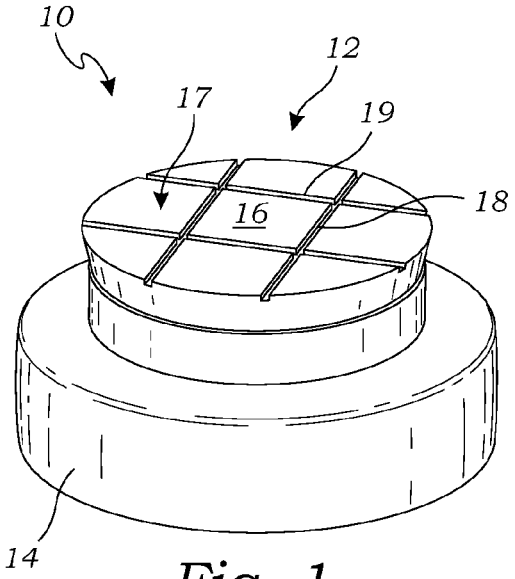
FIG. 1 is a perspective view of a myofascial release tool according to one embodiment of the present invention.

FIG. 1 is a perspective view of the myofascial release tool 10 according to one embodiment of the present invention. The myofascial release tool 10 has a gripping head 12 that provides a rubbery, high friction gripping surface 16, and also a bulbous body 14 opposite the gripping surface 16 that is adapted for grasping by hand. The gripping head 12 may be formed of a dense rubber, a suitable plastic, or any other suitable material that provides a comfortable tool for gripping the skin of the user. The gripping surface 16 may include a plurality of grooves 17 that enhance the gripping properties of the gripping surface 16. The plurality of grooves 17 may be formed in a grid that includes a horizontal grooves 19 and vertical grooves 18 that intersect at approximately 90 degrees. For purposes of this application, the term "approximately" means +/−10%.

The bulbous body 14 may be formed of any material suitable for gripping (e.g., plastic, rubber, metal, etc.). The ergonomic design of the bulbous body 14 allows clinicians to grasp and manipulate the myofascial release tool 10 to deliver the necessary treatment faster to the patient 20 while reducing the stress on the hands of the clinician. The tools 10 may come in different sizes and shapes that are adapted for use with different body parts.

While FIG. 1 illustrates one embodiment of the myofascial release tool 10, those skilled in the art may devise alternative tools for performing the below-described steps, and such alternative tools (including the bare hands or other body part of the clinician) are considered within the scope of the present invention.

To practice the method of the present invention, it is useful to first determine the extent of the restriction 24 and its orientation. This is achieved by measuring the elasticity of the skin of the patient 20 in various directions, and determining a "scale" of the restriction 24 in each direction. One embodiment of this method is shown in FIG. 2.

Figure 2:
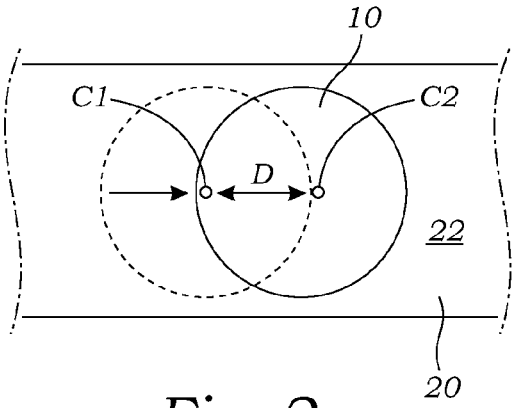
FIG. 2 is a top plan view of the myofascial release tool being used on a patient's limb, illustrating movement of the myofascial release tool to stretch an epidermis of a patient's limb from a relaxed starting position to a stretched position.

FIG. 2 is a top plan view of the myofascial release tool 10 being used on a limb of the patient 20, illustrating movement of the myofascial release tool 10 to stretch the epidermis 22 from a relaxed starting position C1 to a stretched position C2, at which point the fascia restricted. While the myofascial release tool 10 is shown being used on a limb (e.g., arm or leg), it may be used on any body part of the patient 20 that may have a restriction 24.

As shown in FIG. 2, the determination of the restriction scale requires engaging the epidermis 22 of the patient 20 with firm gliding pressure, and then stretching the epidermis 22 in a direction (in this case, a longitudinal direction) a given distance D until the restriction 24 restricts further movement. The distance D that the epidermis 22 can stretch is then measured, and a scale can be determined based upon this distance D.

In this embodiment, the scale of the restriction in the fascia is as follows:

- Scale 0/4=fascia glides 1 cm or more with a normal glide, no restriction.
- Scale 1/4=fascia glides from ¾ cm and less than 1 cm, slight increase in fascia restriction, slight resistance at end range of fascial glide.
- Scale 2/4=fascia glides from ½ cm and less than ¾ cm, moderate increase in fascia restriction, resistance at mid-range of fascial glide.
- Scale 3/4=fascia glides from ¼ cm and less than ½ cm, severe fascia restriction.
- Scale 4/4=Unable to glide the fascia or less than ¼ cm fascia movement. This is typically encountered following surgery or hard scar tissue adhesions.

This process is then repeated in other directions perpendicular to and diagonal to the initial stretch. In this case, the epidermis 22 is stretched in a lateral direction and the restriction scale rating is determined based upon the distance D that the epidermis 22 can stretch. Based upon the restriction scales measured, a direction of the restriction 24 may be determined.

The above-described scale rating system greatly facilitates treatment of most restrictions; however, there are some restrictions that require alternative methods. For example, the scale rating system does not work with the hands and the feet. When treating these areas, alternative methods must be utilized.

Figure 3:
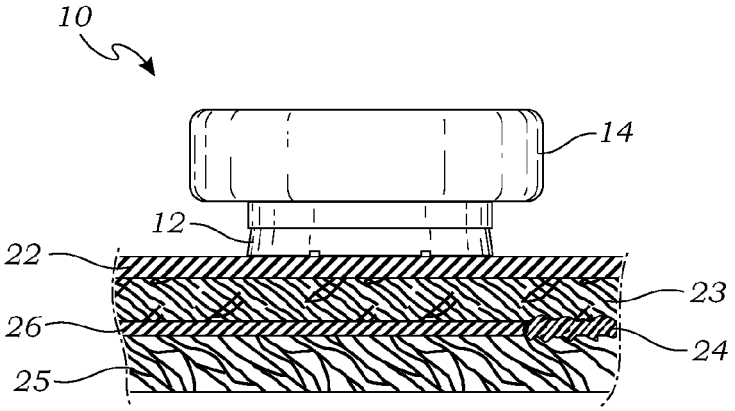
FIG. 3 is a side elevational view of the myofascial release tool in the relaxed starting position.
Figure 4:
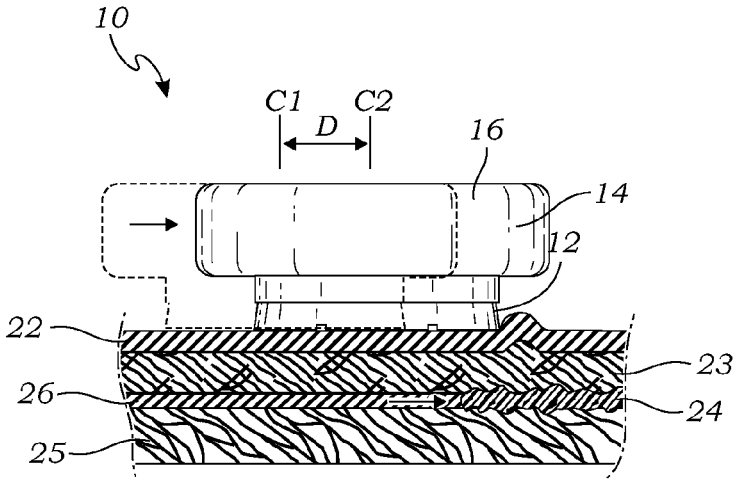
FIG. 4 is a side elevational view of the myofascial release tool moving to the stretched position.

Once the restriction 24 has been determined and characterized, therapeutic steps may be taken to release the restriction 24. FIGS. 2-4 illustrate a first step of the method, as described below. Referring again to FIG. 2, the myofascial release tool 10 is used to stretch the epidermis 22 from a relaxed starting position C1 to a stretched position C2. In this embodiment, the epidermis 22 is stretched traverse to the restriction 24 to the stretched position C2, at which the movement is restricted by the restriction 24, also seen in FIGS. 2-4.

In the present embodiment, the stretched position C2 is held for 3-5 seconds, and then a series of rapid glides is used to release the restriction 24. These steps are shown in FIGS. 3-7, and discussed in greater detail below.

FIG. 3 is a side elevational view of the myofascial release tool 10 in the relaxed starting position C1 on the epidermis 22. As shown in FIG. 3, the term "epidermis" 22 may include multiple layers (e.g., the dermis, the hypodermis, and others, as known in the art), one intermediate layer 23 (which may include one or more layers); however, the detailed structure of the flesh is not shown or described in detail herein. Underneath the epidermis 22 is a fascia layer 26 surrounding muscle tissue 25. It is worth noting that the restriction may prohibit some or all of the various layers from moving. The restriction in the proper movement of the various layers can cause a wide array of health problems.

The term "firm gliding pressure" is defined to include enough downward force to grip the epidermis 22 and the fascia layer 26, but not enough downward force to engage the muscle tissue 25 of the patient 20. For purposes of this application, we refer to the movements utilized as moving "in two dimensions", which is hereby defined to mean along the imaginary plane of the epidermis 22 (which may be curved in places), and not extending upwardly off the epidermis 22 or downwardly into the muscle tissue 25. This pressure distinguishes the present release method from many massage techniques, which include much greater downward pressure to engage and massage the muscle tissue 25 under the epidermis 22.

FIG. 4 is a side elevational view of the myofascial release tool 10 moving to the stretched position C2, wherein the stretching is in a direction traverse to the restriction 24. As shown in FIG. 4, the firm gliding pressure continues to leave the underlying muscle tissue 25 unengaged, but stretches the epidermis 22 to the point of the restriction 24.

Figure 5:
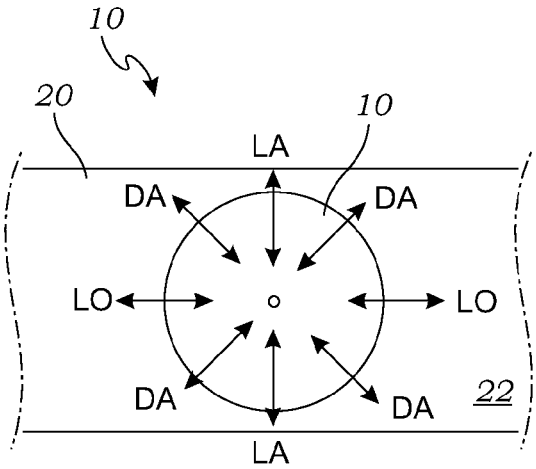
FIG. 5 is a top plan view of the myofascial release tool on the limb of the patient illustrating a first movement series of the myofascial release tool around the stretched position.

FIG. 5 is a top plan view of the myofascial release tool 10 on the limb of the patient 20 illustrating a first movement series of the myofascial release tool 10 around the stretched position C2, wherein the series of rapid glides include 2-4 movements in each of a longitudinal axis LO, a lateral axis LA, and both diagonal axes DA. In this embodiment, the series of rapid glides includes four gliding movements, a longitudinal glide, a lateral glide perpendicular to the longitudinal glide, a left diagonal glide, and a right horizontal glide, the left and right diagonal glides being between the longitudinal and lateral glides.

Figure 6:
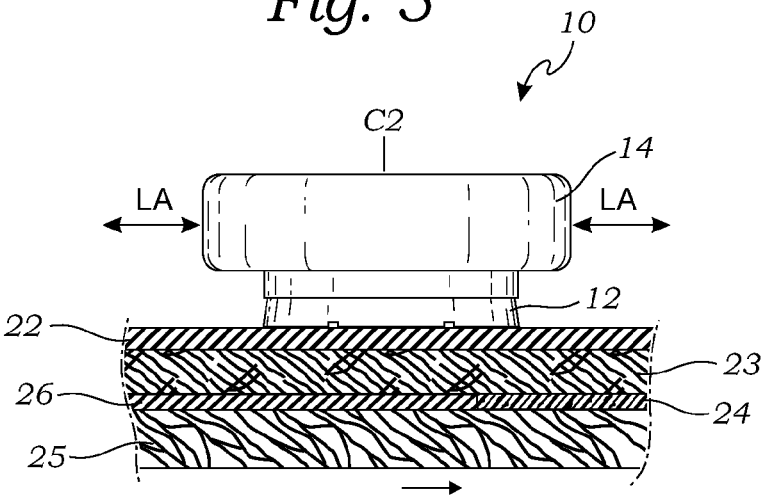
FIG. 6 is a side elevational view of the myofascial release tool of FIG. 5, illustrating how the movement of FIG. 5 causes the restriction to release.

FIG. 6 is a side elevational view of the myofascial release tool 10 of FIG. 5, illustrating how the movement of FIG. 5, in this case on the lateral axis LA, causes the restriction 24 to release. Once released, the epidermis 22 can move freely with respect to the fascia layer 26, achieving the desired therapeutic benefit.

Figure 7:
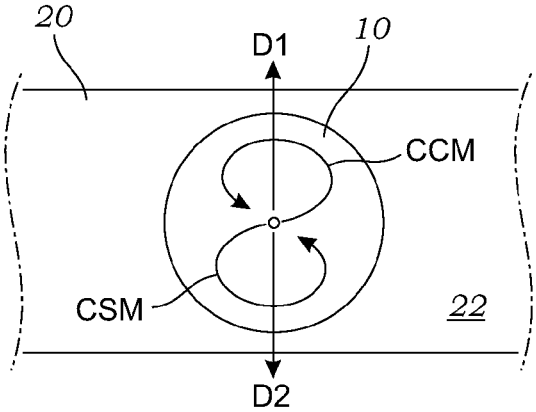
FIG. 7 is a top plan view of the myofascial release tool on the limb of the patient illustrating a second movement series around the stretched position.

FIG. 7 is a top plan view of the myofascial release tool 10 on the limb of the patient 20, illustrating a second movement series around the stretched position C2. In this second movement series the series of rapid glides includes a clockwise semi-circular motion CSM, and a counter-clockwise semi-circular motion CCM. In this embodiment, the clockwise semi-circular motion CSM is in a first direction D1, and the counter-clockwise semi-circular motion CCM is in a second direction D2 opposite the first direction.

While two embodiments of the series of rapid glides are shown, alternative motions that are not illustrated may also be used, including a four way glide. In the four way glide, the clinician uses both hands opposite each other to apply pressure in the following directions: up/down, side to side, right/left diagonal, and left/right diagonal.

In another embodiment of the series of rapid glides, the movement is a four way one hand glide. In this motion the therapist applies firm gliding pressure with their palm or fingers in the following directions: up/down, side to side, right/left diagonal, and left/right diagonal.

Another embodiment of the series of rapid glides is the three way glide. In this motion the therapist holds the soft tissue firmly with one hand, and with the other hand the therapist applies firm gliding pressure with his or her palm and/or fingers in the following directions: inferior, inferior left, and inferior right.

Another embodiment of the series of rapid glides is the interlocking glide. In this motion the therapist uses both hands side by side to apply pressure and stretch the treatment area. The gliding motion employs a twist in opposing semi-circular motions.

Another embodiment of the series of rapid glides is the interlocking with thrust glide. This motion is identical to the interlocking glide motion, the only addition being the application of a slight pressurized thrust on the treatment area while employing the twist in the gliding motion.

Another embodiment of the series of rapid glides is the one direction glide. In this motion the therapist applies firm gliding pressure with their palm or fingers in either transverse or longitudinal direction in relation to the muscle fibers. Another variation of the one direction glide is both hands going towards the same direction to treat more muscle fibers at the same time.

Another embodiment of the series of rapid glides is the glide with rolling. In this motion the therapist applies firm pressure with both hands and rolls the skin opposite to each other or place both hands side by side.

Another embodiment of the series of rapid glides is the zig-zag glide. In this motion the therapist applies firm gliding pressure with their palm or fingers in a zig-zag direction either transverse or longitudinal to the muscle fibers.

Another embodiment of the series of rapid glides is the circle glide with a stretch. In this motion the therapist stretches the restricted fascia and performs a circle motion with the same hand using the myofascial release tool 10.

Another embodiment of the series of rapid glides is the half circle glide with stretch. In this motion the therapist applies stretches the restricted fascia and performs a half circle motion with the same hand using the myofascial release tool 10.

Another embodiment of the series of rapid glides is the fast fascial release. In this motion the therapist applies glides the fascia in all directions while the patient 20 is contracting the muscle associated with the fascia area.

While these particular motions are known to be effective, those skilled in the art may devise alternative motions, and such alternatives should be considered within the scope of the present invention.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A method for achieving myofascial release of a restriction of a fascia layer in a patient via manipulation of the patient's epidermis adjacent the restriction, the method comprising the steps of:

providing a myofascial release tool comprising a gripping head that provides a rubbery, high friction gripping surface, and a bulbous body opposite the gripping surface that is adapted for grasping by hand, wherein the gripping surface includes a plurality of grooves that are formed in a grid that includes a horizontal grooves and vertical grooves that intersect at approximately 90 degrees;

engaging the epidermis of the patient with firm gliding pressure that is enough to grip the epidermis;

stretching the epidermis to a stretched position at which the movement is restricted by the restriction; and performing a series of rapid glides in two dimensions, longitudinal, lateral, and diagonal, around the stretched position, with firm gliding pressure to release the restriction.

2. The method of claim 1, wherein the firm gliding pressure includes enough downward force to grip the epidermis and the fascia layer, but not enough downward force to engage muscle tissue of the patient.

3. The method of claim 1, wherein the stretching is in a direction traverse to the restriction.

4. The method of claim 1, wherein the series of rapid glides include 2-4 movements in each of a longitudinal axis, a lateral axis, and two diagonal axes.

5. The method of claim 1, wherein the series of rapid glides includes four gliding movements, a longitudinal glide, a lateral glide perpendicular to the longitudinal glide, a left diagonal glide, and a right horizontal glide, the left and right diagonal glides being between the longitudinal and lateral glides.

6. The method of claim 1, wherein the series of rapid glides includes a clockwise circular motion and a counter-clockwise circular motion.

7. The method of claim 1, wherein the series of rapid glides includes a clockwise semi-circular motion and a counter-clockwise semi-circular motion.

8. The method of claim 7, wherein the clockwise semi-circular motion is in a first direction, and the counter-clockwise semi-circular motion is in a second direction that is opposite the first direction.

9. The method of claim 1, further comprising the step of holding the stretched position at least 3 seconds before performing the series of rapid glides.

10. The method of claim 1, further comprising the step of holding the stretched position for 3-5 seconds before performing the series of rapid glides.

11. A method for achieving myofascial release of a restriction in fascia layer of a patient via manipulation of the patient's epidermis adjacent the restriction, the method comprising the steps of:

providing a myofascial release tool comprising a gripping head that provides a rubbery, high friction gripping surface, and a bulbous body opposite the gripping surface that is adapted for grasping by hand, engaging the epidermis of the patient with firm gliding pressure;

stretching the epidermis in a longitudinal direction and determining a restriction scale rating based upon the distance that the epidermis can stretch, the restriction scale rating being a measurement of how freely the epidermis can stretch in specific directions;

stretching the epidermis in a lateral direction and determining a restriction scale rating based upon the distance that the epidermis can stretch;

determining a direction of the restriction based upon the restriction scales measured;

stretching the epidermis traverse to the restriction to a stretched position at which the movement is restricted by the restriction;

holding the stretched position for 3-5 seconds; and performing a series of rapid glides around the stretched position to release the restriction.

* * * * *